US005244232A

United States Patent [19]

Dulberger

[11] Patent Number: 5,244,232

[45] Date of Patent: Sep. 14, 1993

[54] ATTACHABLE BOOKMARK

[76] Inventor: Kellie J. Dulberger, 10122 Palms Blvd., #17, Los Angeles, Calif. 90034

[21] Appl. No.: 853,116

[22] Filed: Mar. 18, 1992

[51] Int. Cl.[5] ..... B42D 9/00

[52] U.S. Cl. ..... 281/42; 116/237; 116/238

[58] Field of Search ..... 281/42, 45; 116/234, 116/237, 238, 239; 40/352

[56] References Cited

U.S. PATENT DOCUMENTS

| | | | |
|---|---|---|---|
| 785,215 | 3/1905 | Hill | 281/42 |
| 3,670,691 | 6/1972 | Anderson | 281/42 X |
| 4,982,685 | 1/1991 | Abe | 281/42 |

FOREIGN PATENT DOCUMENTS

| | | | |
|---|---|---|---|
| 252768 | 1/1948 | Switzerland | 281/42 |
| 24930 | of 1909 | United Kingdom | 281/42 |

*Primary Examiner*—Mark Rosenbaum
*Assistant Examiner*—Willmon Fridie, Jr.

[57] ABSTRACT

A bookmark comprised of two connected pieces. The clip piece, made of unyielding material and comprised of three portions attaches to the binding of any reading material. The prong portion of the clip is inserted between two pages, the bend portion rests on the top of the binding of the marked material and the base portion lays on the outside of the binding and provides a base for attachment to the second piece. The second piece, a long thin ribbon has one end attached to the base portion of the clip, the length of which is left free to mark a page.

1 Claim, 2 Drawing Sheets

ATTACHABLE BOOKMARK

BACKGROUND OF THE INVENTION

1. Field of Invention

This invention relates to bookmarks, more specifically to bookmarks which are attachable to a book.

2. Description of the Prior Art

There currently exist many different types of attachable bookmarks. Of the current designs, no one design meets the desirable standards of unlimited usage, compact design, attachment at the binding and low manufacturing cost.

Many of the current attachable bookmarks have limited use since they are designed to attach to binding covers or to hard covers. Paperback books, magazines and other soft covered reading materials, which lack binding covers or sturdy hard covers often cannot support these types of attachable bookmarks.

Most attachable bookmarks lack a compact design. Often portions of the bookmark extend beyond the top and/or sides of a book's surface when attached. Portions that extend beyond a book's surface are subject to breakage. They are also more likely to catch on other objects, which may dislodge them or damage the contacted object. Transporting books marked by these types of bookmarks becomes a problem, especially when they are carried in bookbags, backpacks, briefcases or purses where they are likely to come into contact with other objects.

Some attachable bookmarks must be attached to the cover of a book instead of to the binding area. It is preferable to have the bookmark attach to the binding area because then the reader has simply to pull down on the page marker from its attachment at the binding for immediate placment into the core of the binding. The pressure of the bound pages at the core helps to keep the marker secure. When the bookmark is attached to the page cover, pulling straight down on the marker will not place the marker at the core of the binding. At best, the marker lays midway along the page as far away from the core as the attachment mechanism is from the core.

Often attachable bookmarks are made of a multitude of connected pieces. Such construction leaves the bookmark vulnerable to malfunction, unnecessarily complicated to use and expensive to manufacture.

Some examples of prior developments follows:

| Country | U.S. Pat. No. | Patentee | Issue Date |
|---|---|---|---|
| U.S. | 785,215 | George W. Hill | March 21, 1905 |
| U.S. | 3,670,691 | Isabel H. Anderson | June 20, 1972 |
| U.S. | 4,982,685 | Mitsuhiko Abe | Jan 8, 1991 |
| England | 24,930 | Charles E. Green | Oct 29, 1909 |
| Confed. Suisse | 252,768 | Kimon Collas | Oct 16, 1948 |

U.S. Pat. No. 785,215 illustrates an attachable bookmark that necessitates two separate methods of attachment to be useful on both hard cover books and magazines. The clip mechanism connects to binding covers of hard books, while the prong mechanism must be used on magazines. While one is in use, the other is unnecessary.

It must also be noted that portions of the bookmark extend beyond the surface of the book it marks, making it suseptible to breakage, more vulnerable to dislodgement and potentially dangerous to objects it comes into contact with.

U.S. Pat. No. 3,670,691 illustrates an attachable bookmark which as best understood is attached by gripping one or more pages between two tines. Attachment by gripping one or more pages between two tines is not a preferable form of attachment because it reduces the ease of movement of the pages clasped between the tines. It is also more likely to slide forward since nothing restricts such movement.

In addition, the method of attachment of the ribbon to the tines necessitates that a portion extend beyond the surface of the book. Extending portions are more likely to suffer breakage, cause dislodgement of the bookmark or injure objects with which they come into contact.

U.S. Pat. No. 4,982,685 illustrates an attachable bookmark which is more suitable for hardcover books since it requires attachment to a book cover. Soft covers, which deteriorate with time and use are less able to effectively support this type of bookmark.

British Pat. No. 24,930 illustrates an attachable bookmark that requires two separate origins for attachment. This bookmark attaches on the binding cover of hard books and on the page cover of soft covered reading materials. Attachment to the page cover is not desirable if possible since it is more difficult to position the marker at the core of the binding. The further the marker is from the core, the more likely it is to slide out of the book it is meant to mark.

Confed. Suisse Pat. No. 252768 illustrates an attachable bookmark which is unnecessarily complicated. The bookmark first must be attached to the bottom of a book. The page marker then must be placed up the book to get it into position to be brought back down between two pages to mark them. Attachment at the bottom and running the marker up the page is unnecessary when a bookmark can be attached at the binding. An additional problem with this bookmark is that there is nothing to prevent the bookmark from sliding out from between the pages. The reader would have to be mindful of the marker at all times to prevent the marker from sliding out of the book it is meant to mark.

SUMMARY OF THE INVENTION

The present invention is a reusable attachable bookmark composed of two simple connected pieces. It is simple to attach to the binding of either hard cover or soft cover reading materials. Once attached, it lays flat against all sides of the reading material that it marks. Because this invention comprises few and simple pieces, it is also inexpensive to manufacture.

The simplicity of two connected pieces makes it easy to use, less likely to malfunction and inexpensive to manufacture.

It attaches to any type of reading material without having to incorporate different forms of attachment for different types of reading materials.

Regardless of the reading material, it attaches at the top of the binding area, which is preferable since such placement makes it easy for the reader to pull the ribbon straight down and into the core of the binding where the pressure of the bound pages keep it secure.

It lays flat against the surface of the reading material it marks which prevents breakage of the bookmark by obstruction with other objects. Also because no portions extend beyond the surface of the reading material it is attached to, it cannot become dislodged by interference with other objects or damage them.

DRAWING REFERENCE NUMERALS

Figure 1B:
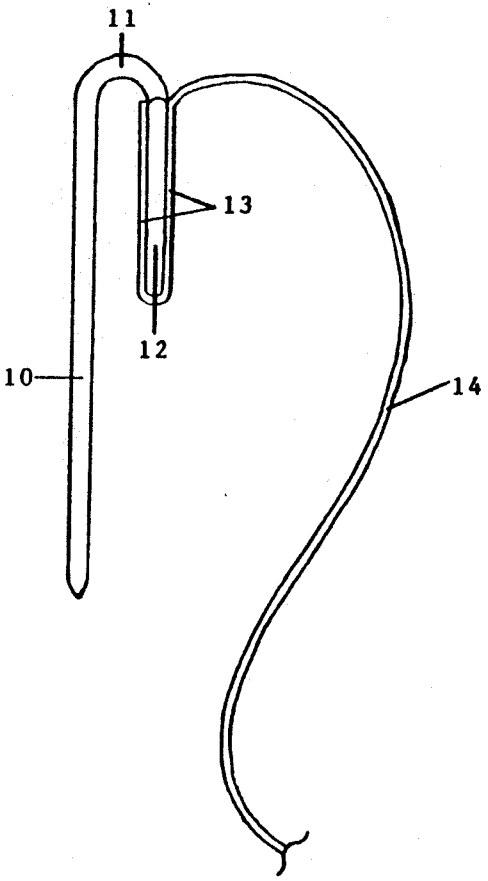
FIG. 1*b* is an exploded side view of the present invention.

10 prong of clip
11 bend in clip
12 base of clip
13 ribbon portion affixed to base of clip
14 length of ribbon
15 outside of a book's binding

DESCRIPTION OF THE PREFERRED EMBODIMENTS

Figure 1A:
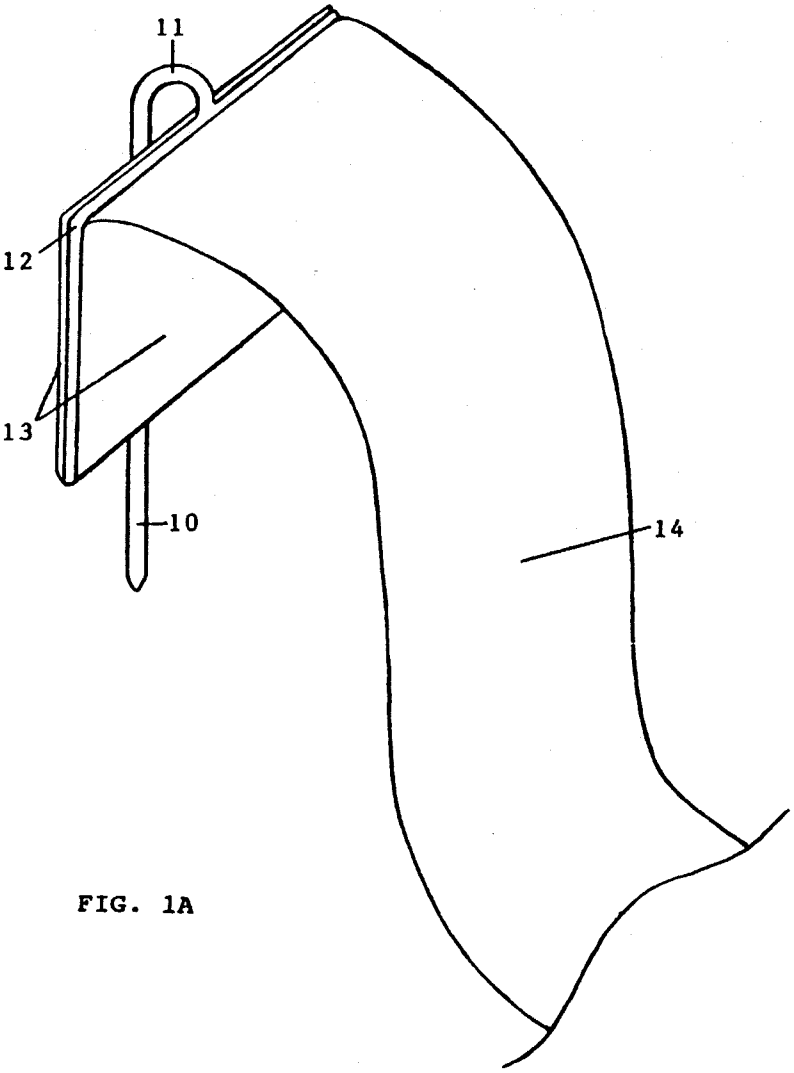
FIG. 1A is an exploded perspective view of the present invention.

FIG. 1A is an exploded perspective drawing of the present invention. The prong 10 is for insertion between two pages in a book. The bend in the clip 11, will rest on the top edge of a book's binding, when the bookmark is attached to a book. The bend in the clip 11, places the prong 10 close to the base of the clip 12, which creates the tension that keeps the bookmark FIG. 1A secure on a book's binding, once it has been attached to a book. The ribbon portion 13 is permanently affixed to the base of the clip 12 with adhesive material. The length of ribbon 14 is for placement between a book's pages to mark them for future reference.

FIG. 1B is an exploded side view of the present invention. The reference numerals describe in FIG. 1A also apply to this figure.

Figures 2A, 2B, 2C:
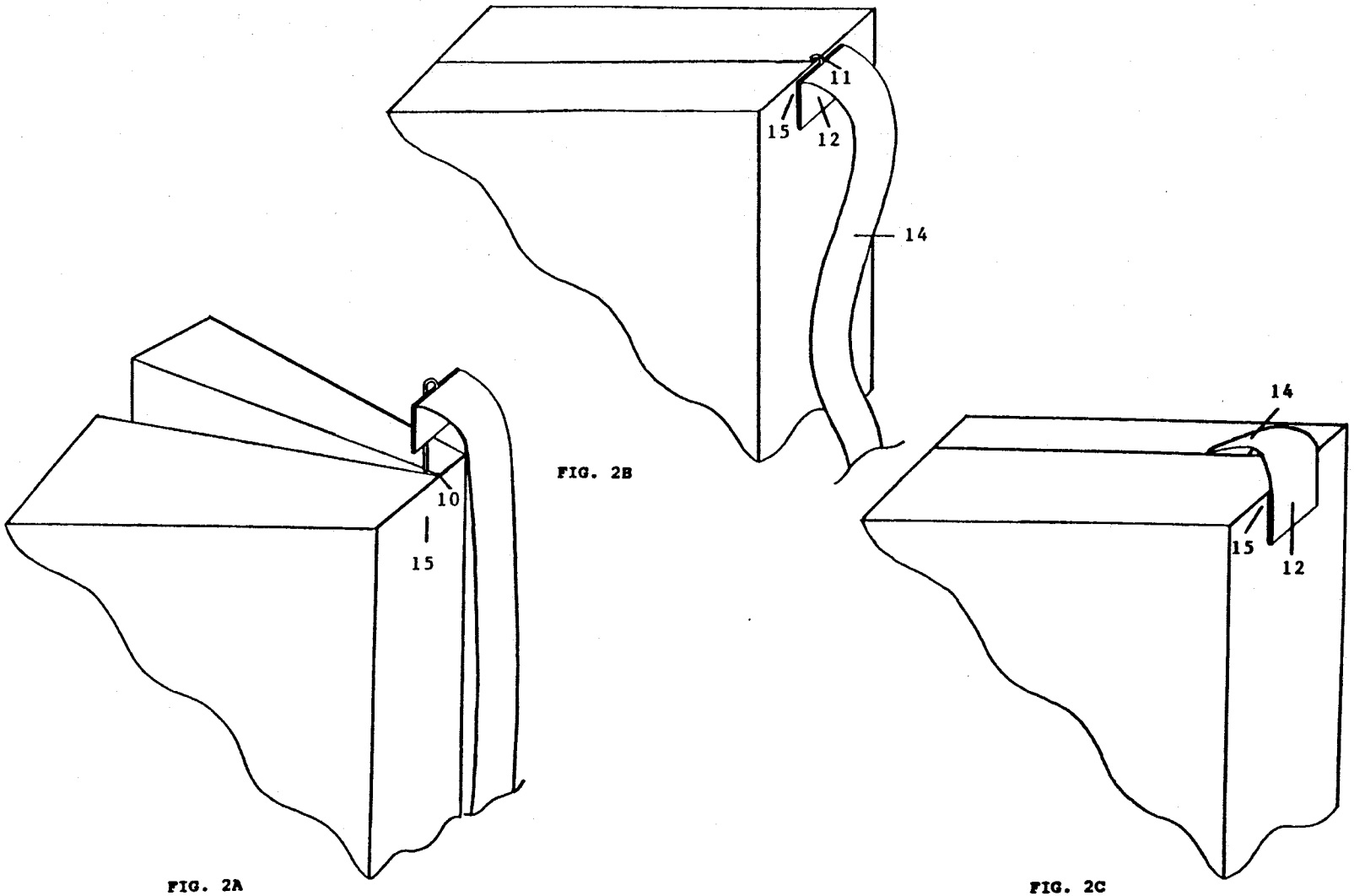
FIG. 2A is an exploded view of the present invention prior to attachment to a book.
FIG. 2*b* is an exploded view of the present invention attached to a book without marking a page.
FIG. 2*c* is an exploded view of the present invention attached to a book, marking a page.

FIG. 2A shows the present invention in position for attachment to a book's binding 15. The book is opened to the approximate middle and the prong 10 is positioned for insertion between two pages.

FIG. 2B shows the present invention attached to a book's binding 15. The bend in the clip 11 rests on the top edge of the book's binding 15. The clip base 12 rests on the outside of the book's binding 15. The length of the ribbon 14 hangs from the outside of the clip base 12. FIG. 2C shows the present invention attached to a book's binding 15. The base of the clip 12 rests on the outside of a book's binding 15. The length of ribbon 14, is placed between two pages of the book to mark them for future reference.

The materials used for the ribbon and clip may vary without altering the essence of this invention.

I claim:

1. A bookmark comprised of two pieces:

A. a clip made of one piece of unyielding material shaped to comprise a narrow pin-like prong portion and a clip base portion, said prong portion, which is for insertion between two pages of a book, at one end curves into a 180 degree bend and is connected to said clip base portion, said bend creates the tension that secures said clip to the binding of any book, aid prong portion further extends from said bend downwardly and parallel to said clip base portion, where said clip base portion is planar chapped for placement on the outside of any book's binding and for providing a place to which the following is attached;

b. a ribbon which has one end permanently sealed to said clip base portion of said clip, the length of which is available for placement between two pages of said book to mark a page for future reference.

* * * * *